United States Patent [19]

Field et al.

[11] 4,111,093

[45] Sep. 5, 1978

[54] STRING INSTRUMENT, IN PARTICULAR A GUITAR WITH FOLDABLE NECK PORTION

[76] Inventors: Roger Field, Cincinnati-Str. 41/B1, Munich 90; Thomas Steger, Kaiser-Str. 34, Munich 40, both of Fed. Rep. of Germany, 8000

[21] Appl. No.: 792,076

[22] Filed: Apr. 28, 1977

[30] Foreign Application Priority Data

Apr. 29, 1976 [DE] Fed. Rep. of Germany ... 7613617[U]

[51] Int. Cl.[2] ..... G10D 3/00; G10D 1/08

[52] U.S. Cl. ..... 84/267; 84/291; 84/293; 84/297 R; 84/307; 84/312 R

[58] Field of Search ..... 84/267, 275, 293, 297 R, 84/292, 298, 299, 312, 291, 307

[56] References Cited

U.S. PATENT DOCUMENTS

| | | | |
|---|---|---|---|
| 350,693 | 10/1886 | Mustill | 84/293 |
| 519,409 | 5/1894 | Middlebrooke | 84/293 |
| 1,785,266 | 12/1930 | Lange | 84/293 |
| 2,464,100 | 3/1949 | Ruggiero | 84/275 |
| 3,159,072 | 12/1964 | Burns et al. | 84/293 |
| 3,910,151 | 10/1975 | Copeland | 84/267 |
| 4,073,211 | 2/1978 | Jorgensen | 84/291 |

*Primary Examiner*—L. T. Hix
*Assistant Examiner*—Benjamin R. Fuller
*Attorney, Agent, or Firm*—Allison C. Collard

[57] ABSTRACT

A string instrument, such as a guitar, includes an instrument body, a neck portion, pivotably coupled to the body by means of a joint, to permit pivotal movement of the neck portion between an operative and a folded position, a string mount moveably mounted on the body, at least one string, one end portion of which is secured to the string mount and the other end portion of which is secured to the neck portion, and drive means for moving the spring mount, which is coupled to the spring mount and the joint. The drive means moves the spring mount in direct response to pivotal movement of the neck portion about the joint, so as to maintain the original length and tension of the at least one string, when the neck portion is moved between the operative and folded positions thereof.

23 Claims, 4 Drawing Figures

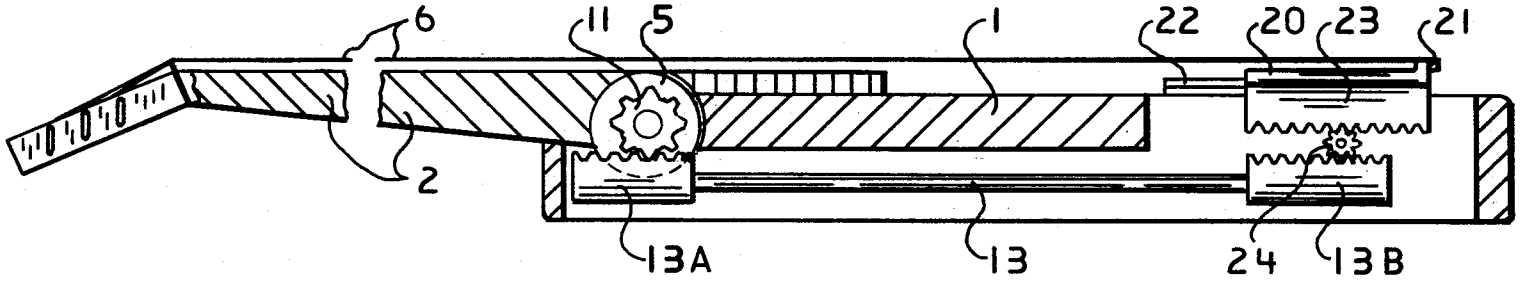
FIG. 3
FIG. 4
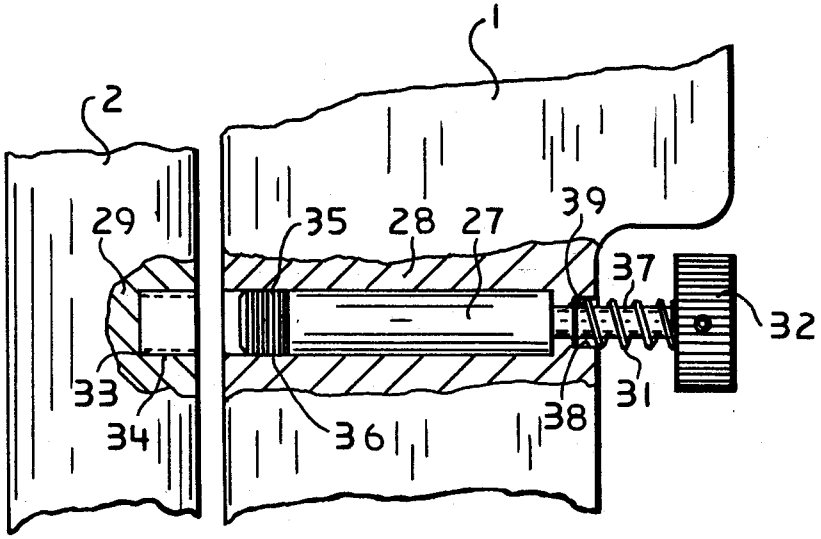

STRING INSTRUMENT, IN PARTICULAR A GUITAR WITH FOLDABLE NECK PORTION

The present invention relates to a string, or stringed, instrument. More particularly, it relates to a guitar with a neck portion which can be folded at a joint arm element. The invention is preferably used with electrical guitars.

In the prior art, it is known to provide a folding mechanism for the neck portion of a string instrument, so that the instrument requires less space during transport. However, constructions of this type were not very successful, because the folding of the neck portion was only possible while simultaneously loosening the strings. When the instrument was folded back into its operating position, the strings did not assume their previous exact tension, so that the exact tuning was lost and the instrument had to be retuned after each folding. Furthermore, the danger exists that the loose strings are subjected to sharp bending and buckling, so that a pure tuning of the instrument is made impossible.

It is therefore an object of the present invention to provide a string instrument with a foldable neck portion, wherein the correct string tension, as well as the exact tuning of the instrument is maintained during frequent folding of the neck portion.

In accordance with the object of the present invention, a string instrument is provided having a string support, which is moveably mounted on the guitar body and is coupled with the pivotable movement of the neck portion by means of a joint. As a result, the string support undergoes movements which exactly compensate for the longitudinal changes of the strings caused by folding the neck portion of the guitar. Consequently, the strings always have the same length and the same tension, in either the folded or operating position.

In a further embodiment, the neck portion is coupled to the guitar body, so that it can be folded backwardly, and a return roller having a large return radius is provided for the strings at the joint, coupling the neck portion and body. Thereby, sharp bending or buckling of the strings is prevented.

Other objects and features of the present invention will become apparent from the following detailed description, considered in connection with the accompanying drawings, which disclose the embodiments of the invention. It is to be understood, however, that the drawings are designed for the purpose of illustration only, and not as a definition of the limits of the invention.

In the drawings, wherein similar reference characters denote similar elements throughout the several views:

FIG. 3 is a side elevational view, in part section, of an alternative embodiment of an electric guitar, embodying the present invention; and FIG. 4 is an enlarged elevational plan view, in part section, of the device for arresting the guitar in operating position, illustrated in FIG. 2.

Figure 1:
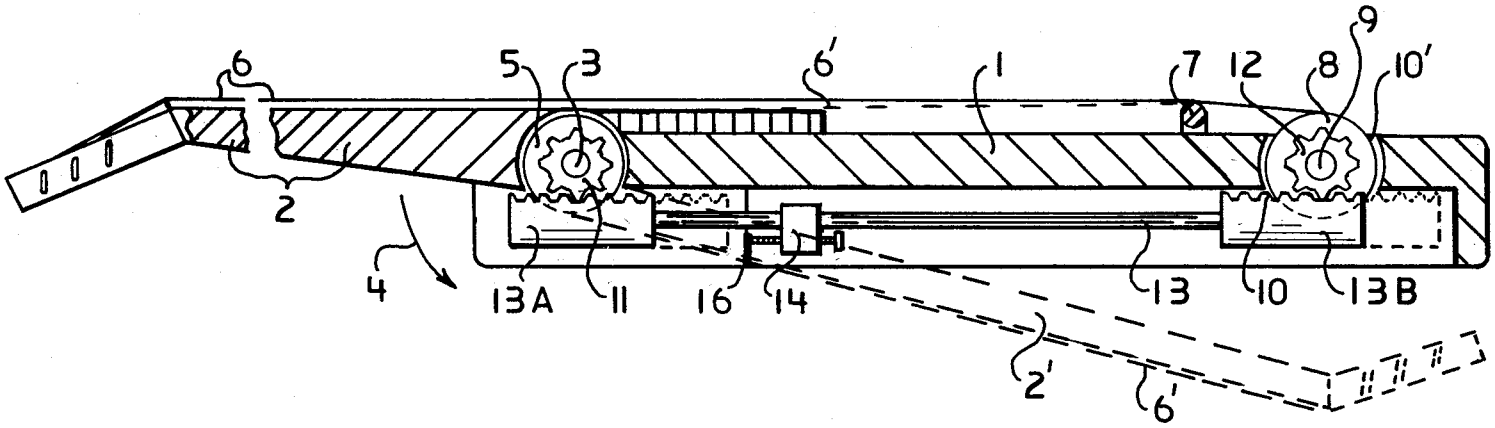
FIG. 1 is a side elevational view, in part section, of an electric guitar, embodying the present invention.
Figure 2:
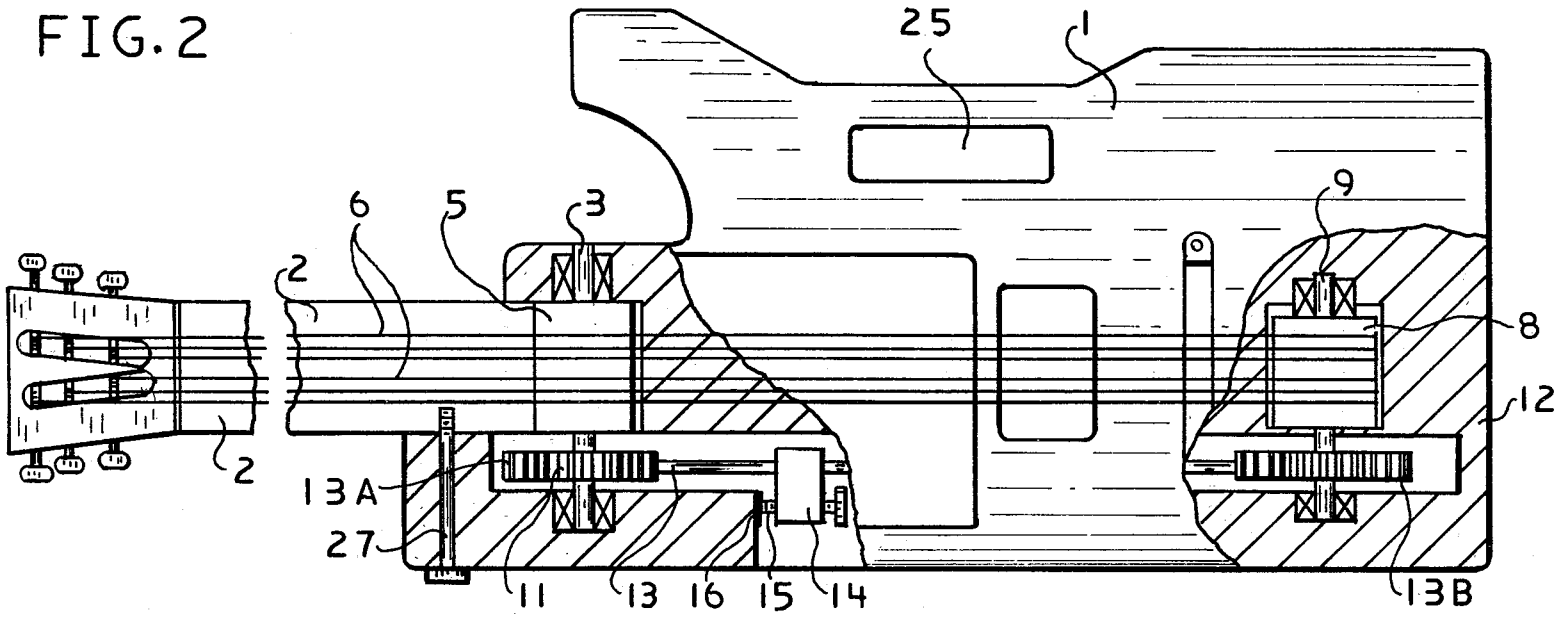
FIG. 2 is a fragmentarily-illustrated, elevational plan view, in part section, of the guitar shown in FIG. 1.

Referring now in detail to the appended drawings, FIGS. 1 and 2 show the body 1 of the instrument, which may be a massive wooden body without resonance characteristics, as in the case of an electric guitar. Neck portion 2 is mounted in a joint with joint shaft 3 on body 1, and can be folded in the direction of arrow 4 into the position 2', indicated by the dotted lines in FIG. 1. A return roller 5 for strings 6 is mounted coaxially on joint shaft 3, and is rigidly connected with neck portion 2. When neck portion 2 is folded, strings 6 engage with a large bending radius around return roller 5, and assume a position 6', as indicated with the dotted line in FIG. 1. Since roller 5 is connected with neck portion 2 and turns therewith, no counteracting displacement and friction of strings 6 takes place on roller 5. Strings 6 run over an increased or elevated rib 7, in the form of a rotatable roller, to string mount 8, which is in the form of a roller and mounted on shaft 9. The ends of strings 6 partly run around roller 8, and are anchored thereon, with suitable means, like pins 10, for example. Roller 8 has the same cross-section as return roller 5, and both rollers 8 and 5 may be provided with shallow guide grooves (not shown) for the strings. Rib 7 may also be a simple rib without a rotatable roller, and may be heightwise or vertically adjustable. Alternatively, rib 7 may be omitted, so that strings 6 run immediately from roller 5 to string support 8. However, in this case, string mount 8 should be at an increased or elevated position.

Two, identical gears 11, 12 are mounted on shafts 3 and 9, and are coupled to one another by gear rod or toothed rack 13. In order to save on weight, gear rod 13 is only provided with gear segments 13*a* and 13*b* at both ends, and consists of a thin, smooth rod therebetween. Due to the gear coupling rod, the two rollers 5 and 8 execute common rotating movements in a 1:1 ratio, when neck portion 2 is pivoted. When folding neck portion 2 into the dotted position 2', the anchoring pins 10 on roller 8 move into position 10', whereby strings 6 are unwound from roller 8 in a length which corresponds to the length of the strings which wind around roller 5. Therefore, the exact tension and length of the strings are maintained. When neck portion 2 is moved from position 2' into operative position 2, strings 6 exhibit their original tension, due to the fact that they were not loosened, as a result of which the original tuning of the strings is also maintained.

In order to exactly define the end of the pivot movement of neck portion 2 when reaching the operating position, an abutment 14 with an adjustable screw 15 is provided on gear rod 13, whereby the adjustment screw coacts with abutment face 16 of the guitar body. Naturally, the abutment may also be provided at any other suitable place; for example, in the form of welded distance plates as a rigid, unchangeable abutment. Rollers 5 and 8 and the required drive, consisting of gears, gear rods are mounted in suitable recesses of guitar body 1, and are mounted and guide in a suitable manner, so that the aesthetic appearance of the instrument is not effected.

The embodiment in accordance with FIG. 3 corresponds to the embodiment shown in FIGS. 1 and 2, with the guitar body 1, foldable neck portion 2, return roller 5, gear 11 and gear rod 13, 13*a*, 13*b* also being provided. However, in accordance with the embodiment of FIG. 3, string support or mount 20 is in the form of a plate at the end of which strings 6 are anchored by means of anchoring pins 21; the plate being slidably mounted for movement in a longitudinal direction in a dovetail guide 22 on guitar body 1, for example. String support 20 carries a gear rod or toothed rack depending from its lower side, which is engaged by gear 24 mounted on guitar body 1. By selecting corresponding dimensioned gear 11 and gear 24, a transmission ratio may be obtained, whereby the corresponding displacement path of string mount 20 is the same as the length of strings 6, which wind around roller 5 and correspond to the dependency of the pivot path of neck portion 2.

In order to prevent a folding of neck portion 2 in the operating position, as is schematically shown in FIG. 2, a thread pin 27 may be screwed through body 1 and into neck portion 2. As shown in detail in FIG. 4, thread pin 27 is provided at its front end with a threaded section 36, and at its rear end, with threaded section 37 having a reduced cross-section, at the end of which a knurled knob 32 is mounted. Thread pin 27 is guided in bushing 28, having an indentation 39, so that pin 27 cannot be completely drawn out of bushing 28.

A bushing 29 with a bore and threaded section 33 and a section 34, which mounts the threadless portion of pin 27 in a press seat, is provided in neck portion 2. Bushing 28 has a corresponding section 35, which mounts the threadless portion of pin 27 in a press seat. The two press seats are required in order to balance a clearance of thread section 33 of bushing 29 and the thread section 36 of pin 27, so as to prevent an even slight, tilting movement of neck portion 2 and thereby a changing of the string tuning.

In the position shown in FIG. 4, pin 27 is pulled out. In order to facilitate the pulling out of the pin which is held by the two press seats, section 37 of thread pin 27 carries a spring 31 at the reduced cross-section portion thereof, and is biasly mounted between indentation 39 and knurled knob 32. Essentially, both bushings 28 and 29 have an outer thread, so as to assure a rigid anchoring in guitar body 1 and neck portion 2, respectively.

Various modifications of the above-described embodiments are, of course, possible. For example, in the embodiments shown in FIGS. 1 and 2, rollers 5 and 8 could have different cross-sections, whereby the gear rod drive must have a transmission ratio deviating from the 1:1 ratio with respect to the cross-sections. Instead of the gear rod drive, other drives for coupling the string mount with the joint, are possible, in particular, chain drives, spindles, belt drives, or the like. However, it is to be understood that the drive must be free from play, because such play would result in changing the tuning of the strings. Hence, a gear rod is preferred because it can be easily made as a play-free drive. Furthermore, a manual handle 25 may be provided in guitary body 1, for allowing a comfortable transport of the instrument, when the neck portion is folded.

Accordingly, it should be appreciated that while only a few embodiments of the present invention have been shown and described, it will be obvious to those persons of ordinary skill in the art, that many changes and modifications may be made thereunto, without departing from the spirit and scope of the invention.

What is claimed is:

1. A string instrument, such as a guitar, comprising:

an instrument body;

a neck portion, pivotably coupled to said body by means of a joint, to permit pivotal movement of said neck portion between an operative and a folded position;

a string mount moveably mounted on said body, at least one string one end portion of which is secured to said string mount and the other end portion of which is secured to said neck portion; and drive means for moving said string mount, which is coupled to said string mount, and said joint, said drive means moving said string mount in direct response to pivotal movement of said neck portion about said joint, so as to maintain the original length and tension of said at least one string, when said neck portion is moved between said operative and folded positions thereof.

2. The string instrument according to claim 1, wherein said neck portion in said folded position thereof, lies opposite the rearward face of said body, and wherein said instrument additionally includes a return roller having a relatively large return radius, which is mounted on said joint and which supports said at least one string between the end portions thereof.

3. The string instrument according to claim 2, wherein said string mount comprises a roller.

4. The string instrument according to claim 2, wherein said return roller is rotatably and coaxially mounted on said joint, and is rigidly coupled with said neck portion.

5. The string instrument according to claim 3, wherein said return roller has the same dimensions as said string mount, and is coupled to said string mount by means of said drive means, in a transmission ratio of 1:1.

6. The string instrument according to claim 3, wherein said return roller and said string mount each have guide grooves for said at least one string.

7. The string instrument according to claim 2, wherein said string mount comprises a plate slidably supported for movement in a path parallel to the longitudinal direction of said at least one string, and wherein said drive means moves said plate relative to pivotal movement of said neck portion, in such a transmission ratio that the degree of movement of said plate along said path is equivalent to the pivot angle of said neck portion multiplied by the radius of said return roller.

8. The string instrument according to claim 1, wherein said drive means comprises a first gear coupled to said joint and a second gear coupled to said string mount, and a gear rod having toothed, rack sections at the ends thereof, one of which is in mesh with said first gear and the other of which is in mesh with said second gear, said gear rod being moveably guided along said body of said instrument.

9. The string instrument according to claim 1 additionally including a moveable, limiting abutment for limiting pivotal movement of said neck portion to its original operating position.

10. The string instrument according to claim 9, wherein said moveable abutment is coupled to said drive means.

11. The string instrument according to claim 9, wherein said moveable abutment is adjustable.

12. The string instrument according to claim 2, wherein said drive means, said return roller and said string mount, are mounted in said instrument.

13. The string instrument according to claim 1, additionally including a rib mounted on said body adjacent to said spring mount, over which said at least one string runs.

14. The string instrument according to claim 13, wherein said rib comprises a rotatable roller.

15. The string instrument according to claim 13, wherein said rib is heightwise adjustable.

16. The string instrument according to claim 1, additionally including a manual handle, which is provided in said body.

17. The string instrument according to claim 1, additionally including arresting means for arresting said neck portion in said operating position thereof.

18. The string instrument according to claim 17, wherein said arresting means includes a first bushing having a bore and an internally-threaded portion mounted in said neck portion, a second bushing having a bore mounted in said body portion, said bores of said bushings being alignable upon movement of said neck portion to said operating position thereof, and a thread pin having a threaded end portion, which is guided through said bore of said second bushing, into said bore of said first bushing for threaded engagement with said threaded section thereof.

19. The string instrument according to claim 18, wherein said thread pin is guided in said second bushing with a press seat.

20. The string instrument according to claim 18, wherein said thread pin may be pulled out in limited fashion from said second bushing.

21. The string instrument according to claim 20, wherein a spring is provided for facilitating the pulling out of said thread pin.

22. The string instrument according to claim 18, wherein said first bushing is provided with a section with a press seat for said thread pin.

23. The string instrument according to claim 18, wherein said bushings are provided with outer threads.

* * * * *